US010316577B2

(12) United States Patent
Fontijn

(10) Patent No.: US 10,316,577 B2
(45) Date of Patent: Jun. 11, 2019

(54) RECESSED HANDLE FOR SLIDING WINDOW AND DOOR

(71) Applicant: GOLDBRECHT INC., Culver City, CA (US)

(72) Inventor: Marcel Fontijn, West Hollywood, CA (US)

(73) Assignee: GOLDBRECHT INC., Culver City, CA (US)

( * ) Notice: Subject to any disclaimer, the term of this patent is extended or adjusted under 35 U.S.C. 154(b) by 0 days.

(21) Appl. No.: 14/435,905

(22) PCT Filed: Nov. 10, 2014

(86) PCT No.: PCT/US2014/064747
§ 371 (c)(1),
(2) Date: Apr. 15, 2015

(87) PCT Pub. No.: WO2016/076821
PCT Pub. Date: May 19, 2016

(65) Prior Publication Data
US 2017/0241160 A1 Aug. 24, 2017

(51) Int. Cl.
*E06B 3/46* (2006.01)
*E05B 5/00* (2006.01)
*E05B 65/08* (2006.01)

(52) U.S. Cl.
CPC ..... *E06B 3/46* (2013.01); *E05B 5/00* (2013.01); *E05B 65/08* (2013.01); *E06B 3/4654* (2013.01); *E06B 3/4681* (2013.01); *Y10T 16/458* (2015.01)

(58) Field of Classification Search
CPC ..... Y10T 16/458; E06B 3/46; E06B 3/4654
USPC ..... 52/207; 49/404, 460, 70, 400, 413, 380, 49/209
See application file for complete search history.

(56) References Cited

U.S. PATENT DOCUMENTS 2,760,803 A * 8/1956 Solomon ..... E05B 85/08 292/1
2,952,883 A * 9/1960 Kessler ..... E06B 3/4609 292/202
2,953,824 A * 9/1960 Minick ..... E06B 3/4618 220/378
2,980,969 A * 4/1961 Tinfow ..... A47K 3/34 49/411
2,983,000 A 5/1961 Metzger
(Continued)

FOREIGN PATENT DOCUMENTS

GB 190518617 A * 5/1906
GB 888170 A 1/1962

OTHER PUBLICATIONS

International Search Report for PCT/US2014/064747 dated Mar. 11, 2015.
Written Opinion for PCT/US2014/064747 dated Mar. 11, 2015.

*Primary Examiner* — Marcus Menezes
(74) *Attorney, Agent, or Firm* — Sughrue Mion, PLLC

(57) ABSTRACT

A sliding member for giving the appearance of a vertical translucent edge of a transparent member aligning with an intersecting, perpendicular wall includes a panel having at least one transparent member, a handle connected to the panel, and a jamb recessed in a wall having a recessed door jamb depth, where the handle is at least partially received in the door jamb depth when the sliding member is in a closed position.

16 Claims, 9 Drawing Sheets

(56) References Cited

U.S. PATENT DOCUMENTS

| | | | | | |
|---|---|---|---|---|---|
| 3,173,179 | A * | 3/1965 | Edwards | E06B 3/44 | 160/91 |
| 3,383,801 | A * | 5/1968 | Dallaire | E05B 65/0835 | 49/413 |
| 3,676,895 | A * | 7/1972 | Stewart | E05B 1/0015 | 16/412 |
| 3,997,200 | A | 12/1976 | Brown | | |
| 4,178,718 | A * | 12/1979 | Laby | A47K 3/34 | 49/411 |
| 4,846,089 | A * | 7/1989 | Cedergreen | B63B 19/14 | 114/178 |
| 5,369,969 | A * | 12/1994 | Sassella | E05B 1/0015 | 292/347 |
| 5,676,408 | A * | 10/1997 | Davidian | E05B 65/0811 | 292/197 |
| 6,023,889 | A * | 2/2000 | Husting | A47K 3/30 | 4/607 |
| 6,067,690 | A * | 5/2000 | Herman | E05B 53/001 | 16/412 |
| 7,346,939 | B2 * | 3/2008 | Perry | A47K 3/34 | 4/557 |
| 9,097,038 | B1 * | 8/2015 | Cohen | E05B 65/087 | |
| 2002/0148627 | A1 * | 10/2002 | Seamans | H02G 3/266 | 174/504 |
| 2007/0000179 | A1 * | 1/2007 | Krohn | E06B 3/4645 | 49/449 |
| 2007/0051048 | A1 * | 3/2007 | Krohn | B64C 1/1469 | 49/413 |

* cited by examiner

RECESSED HANDLE FOR SLIDING WINDOW AND DOOR

BACKGROUND

1. Field of the Invention

One or more embodiments of the invention relate to a door for a handle or a window, and more specifically to a door for a handle or window where the handle is recessed in the wall or frame of the window or door.

2. Description of the Related Art

Current sliding door and window function and design provides a handle extrusion on a leading edge of a sliding panel of the door or window. The handle extrusion allows the sliding panel to only partially enter a window or door jamb when the sliding panel is in a closed position (i.e., closing an opening of the window or door). Even if the jamb frame track is flush with an edge of a wall, a relatively large sightline is created as compared to interlocking stiles at the meeting point of other window or door panels. In addition, the handle "pull" itself adds to the sightline created by the handle extrusion, diminishing the viewing area of the panel when the panel is in a closed position.

For example, FIGS. 1-3 show a traditional sliding door 10. As shown in FIG. 1, which is a horizontal view illustrating sliding door 10 in a closed position, sliding door 10 includes a panel 12 and a sash frame 14*a* connected to the panel 12 at one end. The panel 12 includes a first transparent member 12*a* and a second transparent member 12*b* defining a space 12*c* there between.

As shown in FIG. 1, in a traditional sliding door 10, the sash frame 14*a* includes a handle 16 used for opening and closing the sliding door panel 10. Furthermore, the sash frame 14*a* is one member of the sliding door jamb and frame 14. The sliding door jamb and frame 14 also includes the door jamb 14*b*, which is attached to wall 18. In the traditional sliding door 10, the door jamb 14*b* extends from the wall 18 such that the door jamb 14*b* and the sash frame 14*a* extend outside the wall 18 when the sliding door 10 is in a closed position.

As shown in an elevation view in FIG. 2, the sliding door 10 is shown in a closed position. The door jamb 14*b* of the sliding door jamb and frame 14 extends from wall 18. When the sliding door 10 is in a closed position, the sash frame 14*a* abuts the door jamb 14*b*. Since the door jamb 14*b* extends outside the wall 18, the sash frame 14*a*, which is attached to the door panel 12, cannot enter the wall 18. Thus, as seen in FIG. 2, there is a large area of the sliding door 10 that is obstructed by the sash frame 14*a* and the door jamb 14*b*, causing the viewing area of the sliding door 10 and the door panel 12 to be severely diminished.

FIG. 3 is a horizontal view illustrating a traditional sliding door 10 in an open position. An opening 20 is defined between the sash frame 14*a* and the door jamb 14*b*. As can be seen in FIG. 3, the door jamb 14*b* projects from the wall 18. Thus, when the door is closed, the sash frame 14*a* abuts door jamb 14*b* and does not enter the wall 18, as shown in FIGS. 1 and 2, causing increased sightlines through the traditional sliding door 10.

Accordingly, there is a need for a handle for a door or window that can be recessed in wall, such that a door or window having a handle that maximizes the viewing area of the door or window panel and creates a visual appearance that the vertical translucent edge of the glass is aligned with the intersecting, perpendicular wall.

SUMMARY OF THE INVENTION

One or more exemplary embodiments include a door or window handle extrusion that is configured to be recessed in a wall.

Additional aspects will be set forth in part in the description which follows and, in part, will be apparent from the description, or may be learned by practice of the exemplary embodiments.

In accordance with one aspect of an exemplary embodiment, a sliding member includes a panel having at least one transparent member, a handle connected to the panel, and a jamb recessed in a wall by an amount corresponding to a recessed door jamb depth, where the handle is at least partially received in the jamb when the sliding member is in a closed position.

According to another exemplary embodiment, the handle is not visible when viewed in a perpendicular direction with respect to the panel.

According to another exemplary embodiment, the handle is flush with an outer portion of the wall.

According to another exemplary embodiment, the sliding member may further include a sliding panel frame connected to the panel, where the sliding panel frame is flush with the outer portion of the wall and the sliding panel frame is not visible when the sliding member is in the closed position.

According to another exemplary embodiment, the handle may be connected to the sliding panel frame.

According to another exemplary embodiment, the door jamb may include at least one recessed handle pocket, and the at least one recessed handle pocket may be configured to allow a user to interact with the handle.

According to another exemplary embodiment, the at least one recessed handle pocket may extend in a direction perpendicular to a movement of the sliding member.

According to another exemplary embodiment, the at least one recessed handle pocket may extend a length of the door jamb.

According to another exemplary embodiment, the sliding member may further include a lock configured to prevent the sliding member from being opened.

According to another exemplary embodiment, the lock may include at least one protrusion connected to the sliding member, a sliding portion configured to slide within the door jamb, and at least one locking member connected to the sliding portion, where the at least one locking member engages the at least one protrusion when the lock is in a locking position.

According to another exemplary embodiment, the at least one transparent member is transparent, semi-transparent, or opaque.

In accordance with one aspect of an exemplary embodiment, a jamb for a sliding member, the jamb including at least one recessed handle pocket and a receiver, where the jamb is recessed in a wall, and the sliding member is at least partially received by the receiver when the sliding member is in a closed position such that a leading edge of a sliding panel frame is at least partially recessed in the wall when the sliding member is in a closed position.

According to another exemplary embodiment, a handle connected to the sliding member is configured to be flush with the wall and completely recessed in the wall when the sliding door is in a closed position.

According to another exemplary embodiment, the leading edge of the sliding member is completely recessed in the wall when the sliding member is in a closed position.

According to another exemplary embodiment, the jamb further includes a lock configured to prevent the sliding member from being opened.

According to another exemplary embodiment, the lock includes at least one protrusion connected to the sliding member, a sliding portion configured to slide within the door jamb, and at least one locking member connected to the sliding portion, where the at least one locking member engages the at least one protrusion when the lock is in a locking position.

In accordance with one aspect of an exemplary embodiment, a sliding panel frame for a sliding member includes a handle connected to the sliding panel frame and at least one transparent panel, where a leading edge of the sliding panel is at least partially received by a receiver of a jamb such that the sliding panel frame is at least partially recessed in a wall when the door is in a closed position.

According to another exemplary embodiment, the handle is not visible when viewed in a perpendicular direction with respect to the panel.

According to another exemplary embodiment, the sliding panel may include a locking member connected to the sliding panel frame, wherein the locking member is configured to interact with a sliding portion of the jamb to lock the sliding member in a closed position.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
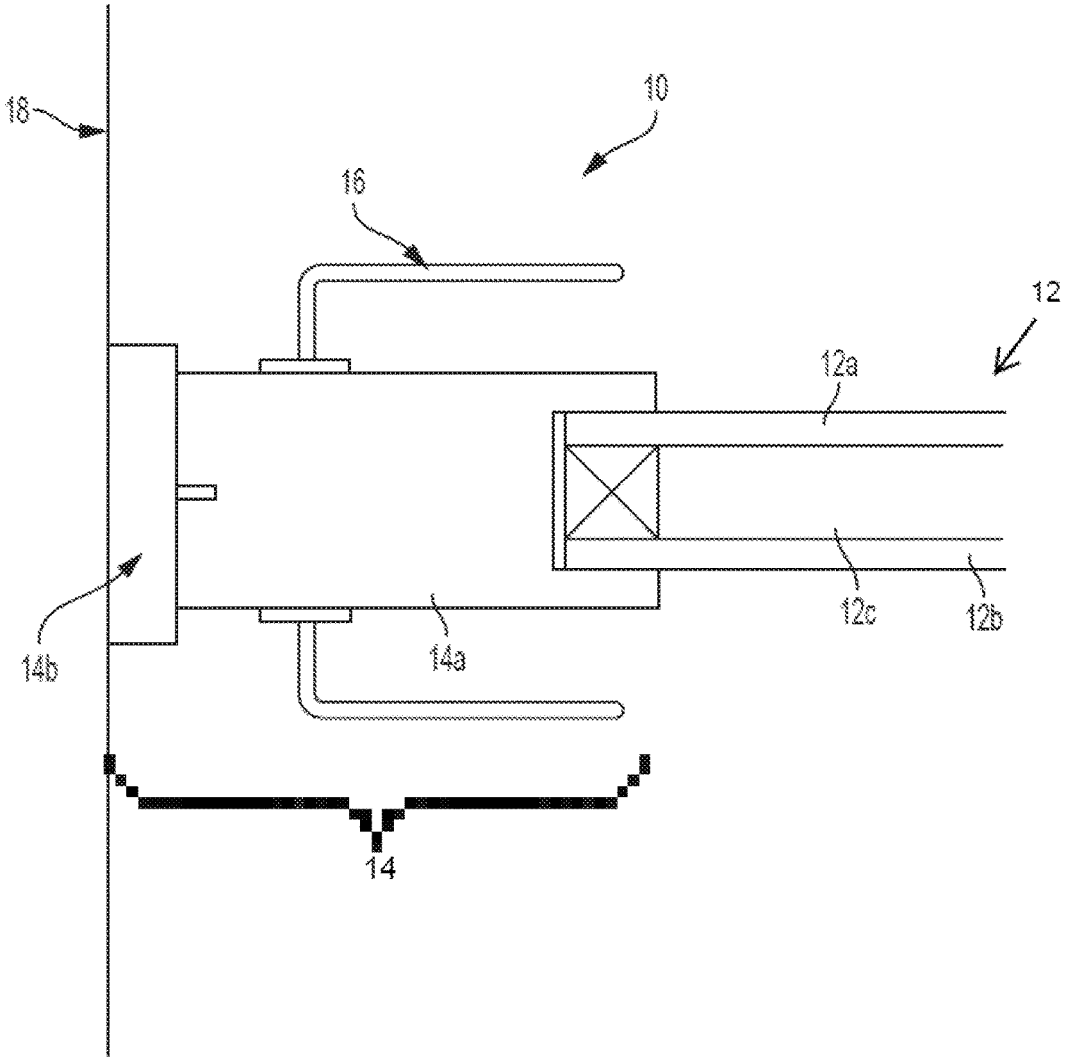
FIG. 1 PRIOR ART
FIG. 1 is a plan view of a traditional sliding door in a closed position.
Figure 2:
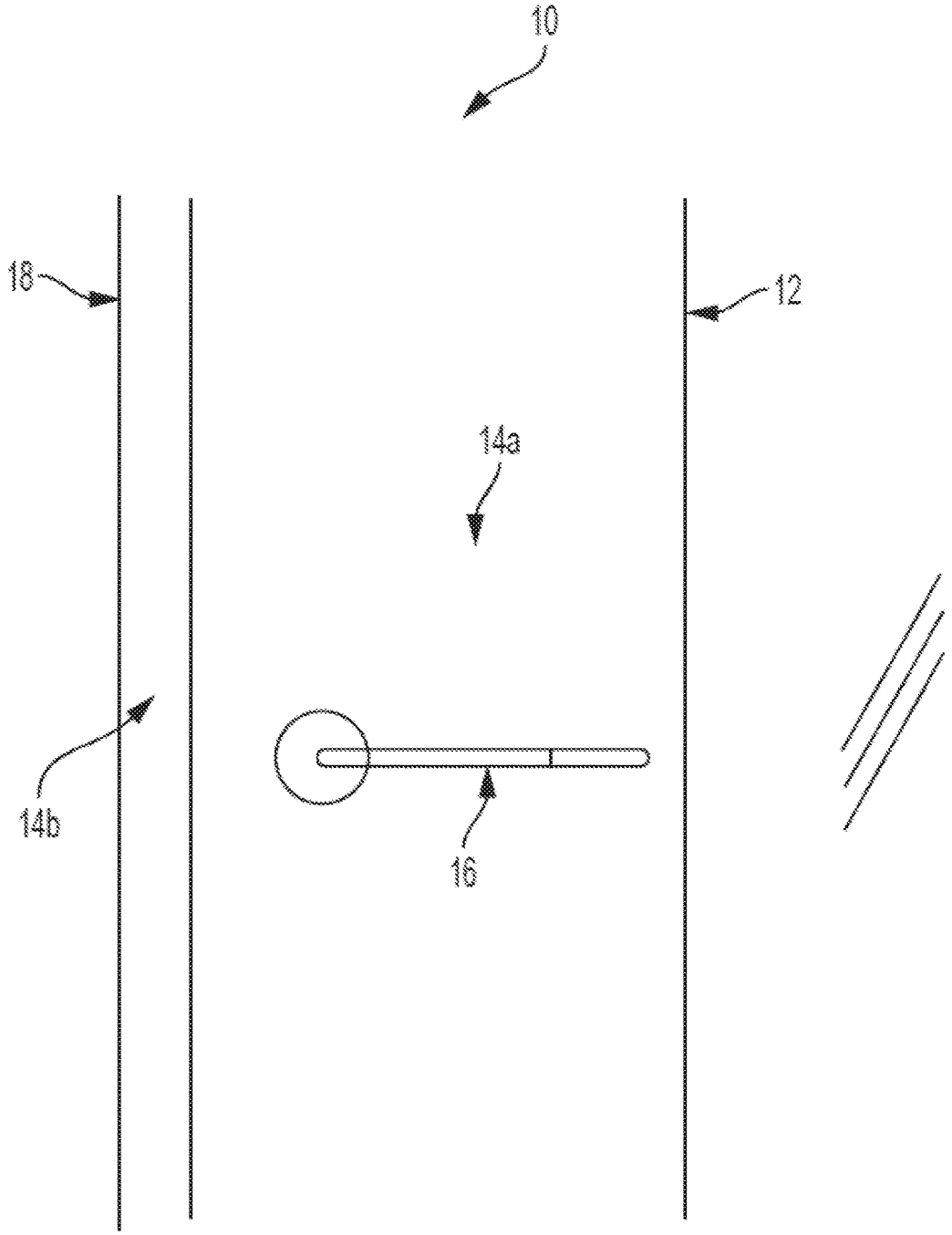
FIG. 2 PRIOR ART
FIG. 2 is an elevation view of a traditional sliding door in a closed position.
Figure 3:
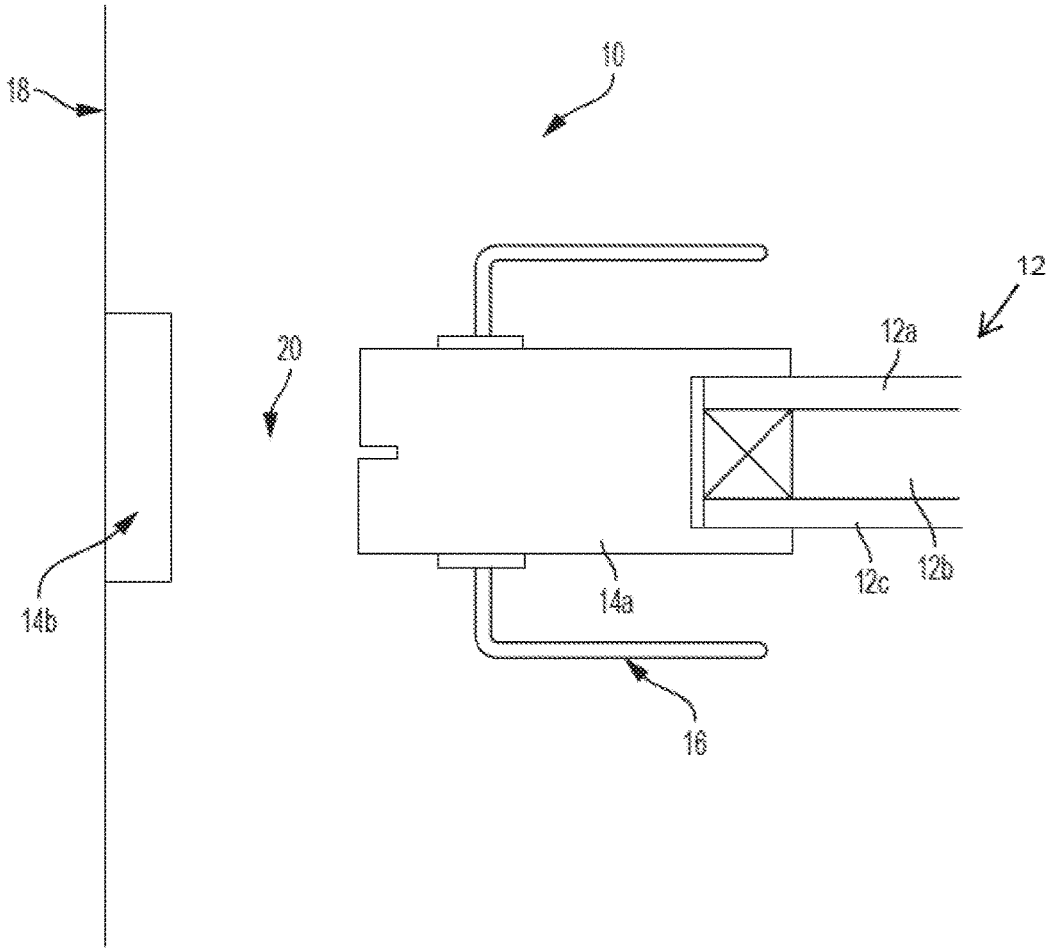
FIG. 3 PRIOR ART
FIG. 3 is a plan view of a traditional sliding door in an open position.

Hereinafter, reference will be made in detail to exemplary embodiments which are illustrated in the accompanying drawings, wherein like reference numerals refer to like elements throughout. In this regard, the present embodiments may have different forms and should not be construed as being limited to the descriptions set forth herein. Accordingly, the exemplary embodiments are merely described below, by referring to the figures, to explain aspects of the present description. When the detailed description of the relevant known function or configuration is determined to unnecessarily obscure the important point of the present invention, the detailed description will be omitted.

The term "sliding door" as recited herein is not limited to a door. "Sliding door" may also include a sliding window or any other sliding panel having the characteristics described herein.

Figure 4:
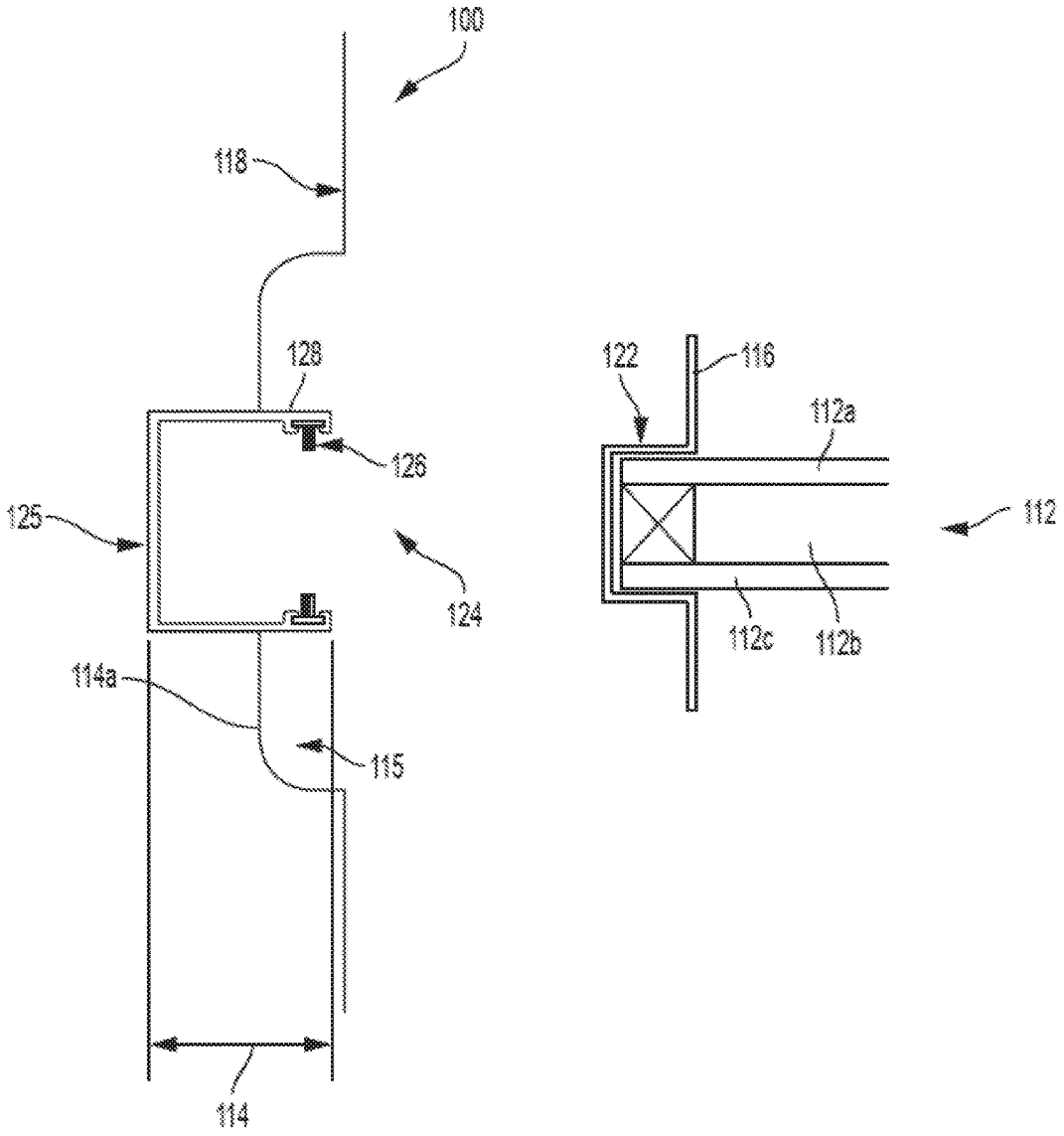
FIG. 4 is a plan view of a sliding door in an open position according to a first exemplary embodiment.

FIG. 4 is a plan view of a sliding door 100 according to a first exemplary embodiment in an open position. As shown in FIG. 4, a jamb 125, which includes a receiver 128 and a recessed handle pocket frame 114*a*, is recessed in a wall 118. The recessed handle pocket frame 114*a* defines a recessed handle pocket 115. The jamb 125 can receive a panel 112 such that a handle 116 of the sliding panel 112 is recessed in the recessed handle pocket 115 and an edge of the sliding panel 112 is recessed in the receiver 128, to maximize the viewing area through the panel 112.

The sliding door 100 includes a panel 112 attached to a sliding panel frame 122. The panel 112 includes a first transparent member 112*a* and a second transparent member 112*c*, defining a space 112*b*. However, exemplary embodiments are not limited thereto, and the panel 112 may include one or more transparent members and may include a plurality of spaces defined between the transparent members or, in some exemplary embodiments, there may be no spaces. Furthermore, the panel 112 may include a transparent member made of any material known in the art. In addition, the transparent member may only be semi-transparent or opaque and may include, but is not limited to, ultraviolet protection and other properties that modify the durability or transparency of the panel 112.

The sliding panel frame 122 may include a projection on both sides of the panel 112, as shown in FIG. 4. These projections form handle 116, which function as a traditional handle, allowing a user to "push" or "pull" the sliding door 100. Exemplary embodiments of the handle 116 are not limited to projections. Instead, the handle 116 may be any handle, lever, or other mechanism known in the art to allow a user to push or pull the sliding door 100. Furthermore, the handle 116 may be directly connected to the panel 112 or the handle 116 may be indirectly connected to the panel 112 through sliding panel frame 122. It will be understood that the sliding panel frame 122 is not limited to a certain size or shape.

Referring to FIG. 4, the sliding door 100 further includes a jamb 125 recessed in a wall 118 by an amount corresponding to a recessed door jamb depth 114, the jamb 125 including a receiver 128 and a recessed handle pocket frame 114*a*, which defines a recessed handle pocket 115. The handle 116 allows a user to open the sliding door 100 from a closed position to an open position. In an open position, an edge of the sliding panel frame 122 of the sliding door 100 and the wall 118 define an opening 124, as further shown in FIG. 4. When the sliding door 100 is in a closed position, a leading edge of the sliding panel frame 122 is received by the recessed door jamb depth 114 such that the sliding panel frame 122 and the handle 116 are recessed in the wall 118. According to the first exemplary embodiment, the handle 116 is recessed in the recessed handle pocket 115. Accordingly, the sliding panel frame 122 is received in the receiver 128 and the handle 116 is received in the recessed handle pocket 115 of the jamb 125, such that the handle 116 is flush with an outer portion of the wall 118.

Figure 5:
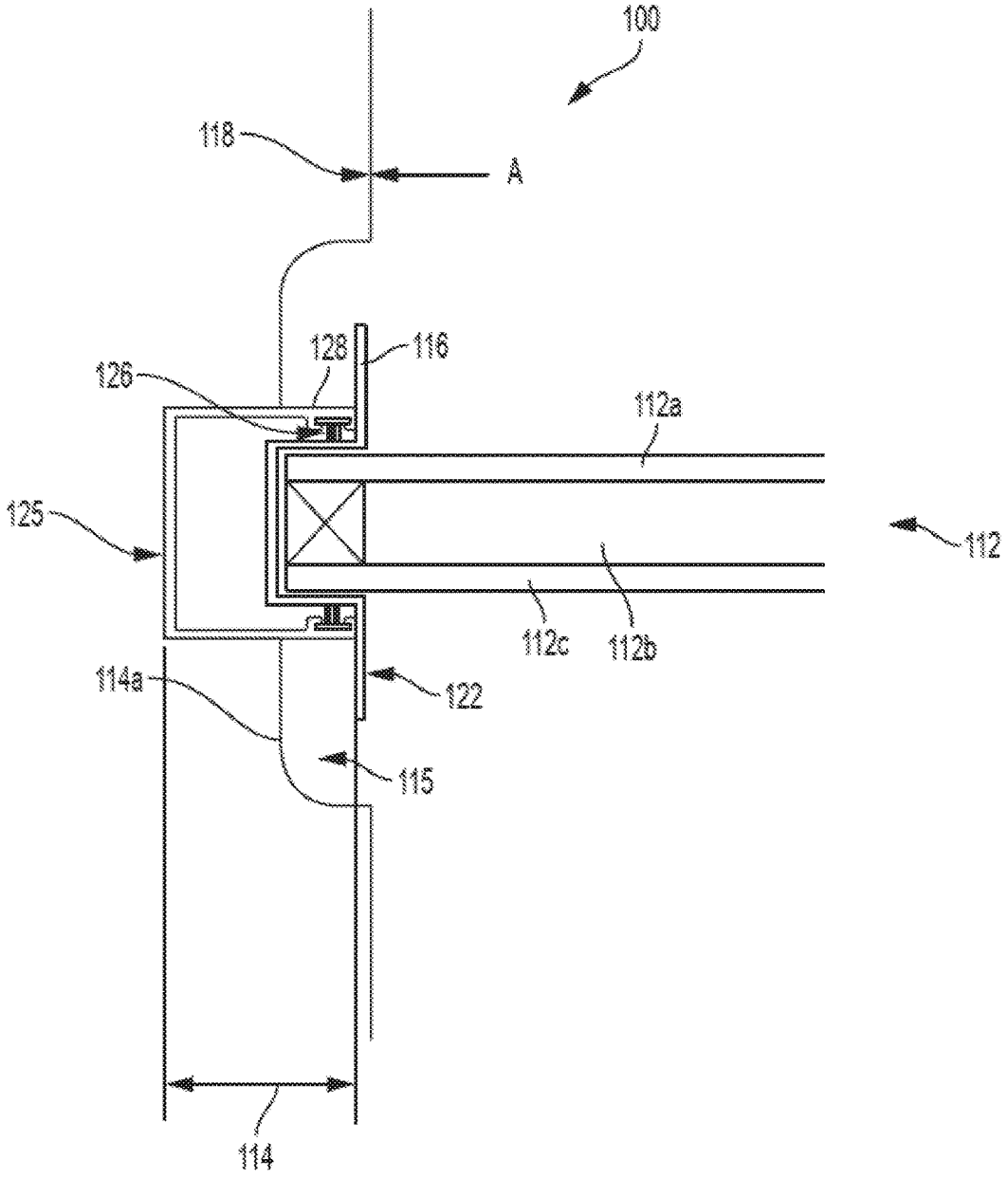
FIG. 5 is a plan view of a sliding door in a closed position according to the exemplary embodiment illustrated in FIG. 4.

According to one exemplary embodiment, when the sliding door 100 is in a closed position, the edge of the sliding panel frame 122 of the sliding door 100 and the wall 118 no longer define an opening, as shown in FIG. 5. Thus, the viewing area of the sliding door 100 is maximized and the visual appearance that the vertical translucent edge of the glass is aligned with the intersecting, perpendicular wall is formed. According to one exemplary embodiment, the receiver 128 acts as a stop for the sliding door 100 to prevent the sliding door 100 from further closing.

According to the first exemplary embodiment, the sliding door 100 may include a seal 126 on the receiver 128, as shown in FIGS. 4 and 5. The seal 126 helps maintain a strong seal between the receiver 128 and the sliding door 100 when the sliding door 100 is in a closed position. It will be understood that the seal 126 is not limited to being located on the receiver 128, but may be placed in any area suitable for providing a seal when the door 100 is in a closed position.

Figure 6:
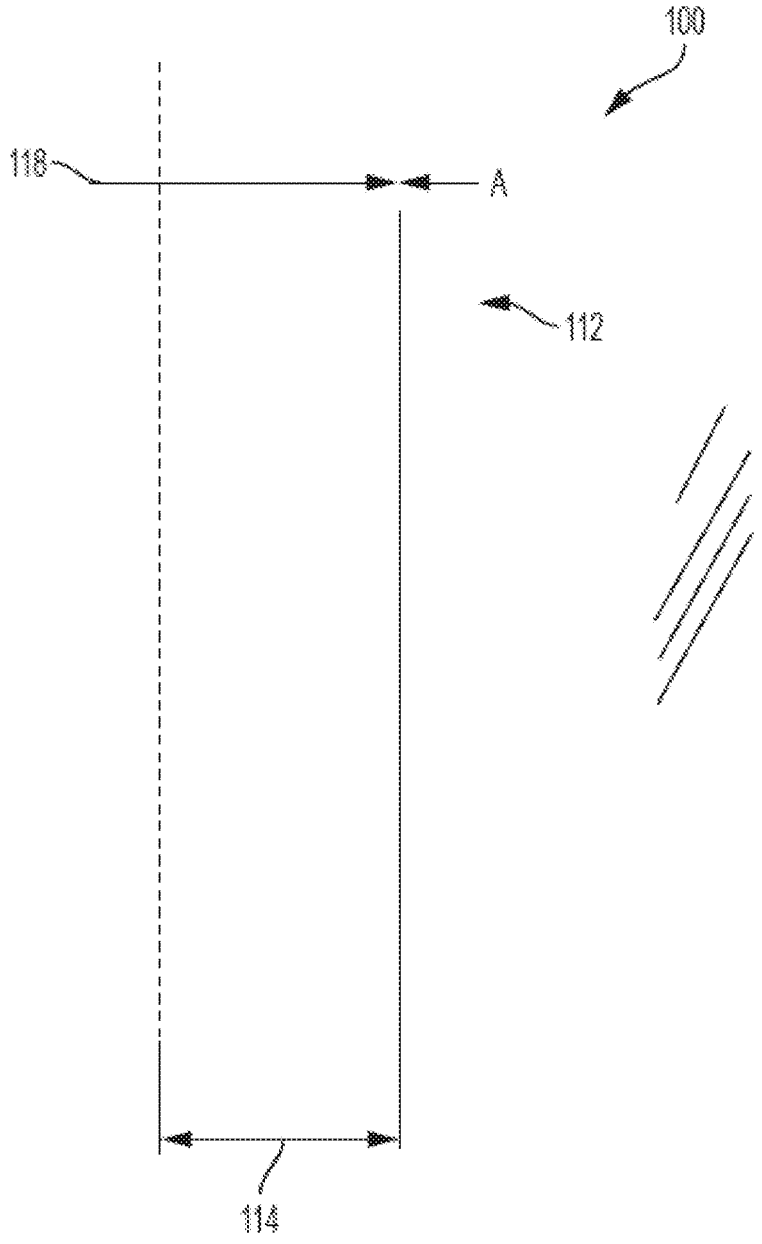
FIG. 6 is an elevation view of a sliding door in a closed position according to the exemplary embodiment illustrated in FIG. 4.

An elevation view of the sliding door 100 in a closed position is shown in FIG. 6. As shown in FIG. 6, the handle 116 is recessed in the recessed handle pocket 115. Accordingly, the panel 112, having translucent members 112*a* and 112*b*, is flush with the wall 118, as shown by reference A, creating the appearance that the panel 112 aligns with the wall 118, maximizing the viewing area of the panel 112.

Figure 7:
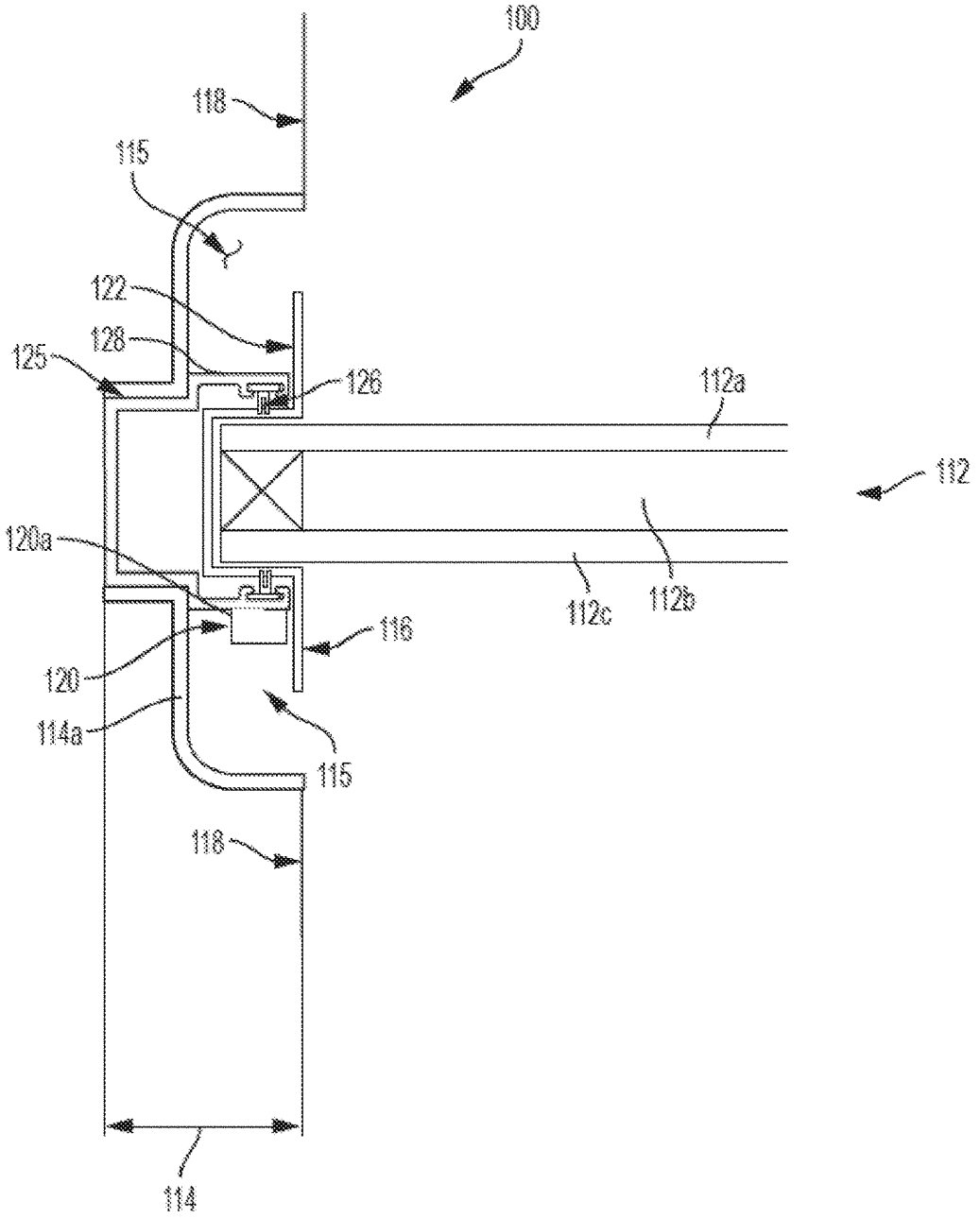
FIG. 7 is a plan view of a sliding door in a closed position with a locking mechanism according to another exemplary embodiment.

Referring to FIG. 7, the jamb 125 is recessed in the wall a depth equal to the recessed door jamb depth 114. The jamb 125 includes a recessed handle pocket 115 on either side of the receiver 128, which is recessed in the wall 118. The recessed handle pocket 115 allows the user to grasp the handle 116 when the sliding door 100 is in a closed position so that the user can move the sliding door 100 to an open position. Furthermore, the recessed handle pocket 115 allows the user to close the sliding door 100 using handle 116, such that the handle is recessed in the recessed handle pocket 115. The recessed handle pocket 115 may extend any length equal to the entire length of the recessed door jamb depth 114 in a direction perpendicular to the moving direction of the sliding door 100 or to a length large enough for a user to engage the handle 116. Furthermore, it will be understood that the jamb 125 may be a jamb for a door, a window, or any other sliding member.

As further shown in FIG. 7, the handle 116 is provided on the sliding panel frame 122. However, the handle 116 may be separately attached to the sliding door 100. Furthermore, the handle 116 is not limited to a handle, but may be any mechanism known in the art to allow a user to push or pull the sliding door 100, so long as the handle 116 and sliding panel frame 122 can be recessed in the jamb 115 when the sliding door 100 is in a closed position.

According to one exemplary embodiment, the sliding door 100 is provided with a lock 120 to lock and prevent the sliding door 100 from being opened. The lock 120 includes a protrusion (not shown) provided on the sliding panel frame 122 and a sliding portion 120*a* provided in the recessed door jamb depth 114 and connected to the jamb 125. The sliding portion 120*a* is capable of sliding within the recessed door jamb depth 114 between a first position and a second position. In a first position, locking members (not shown), which are provided on the sliding portion 120*a*, engage with the protrusions, preventing the sliding door 100 from being opened. When the sliding portion 120*a* is moved into the second position, the locking members are disengaged from the protrusions, allowing the sliding door 100 to be opened. It will be understood that lock 120 is merely one exemplary embodiment of a locking mechanism. For example, other exemplary embodiments of the lock may include a cremone, a pin, a cylinder, a push latch, a hook latch, a bolt latch, or an electromagnet, not of which are shown in the figures. However, these are merely exemplary embodiments, and any locking mechanism known in the art may be substituted for lock 120.

Figure 8:
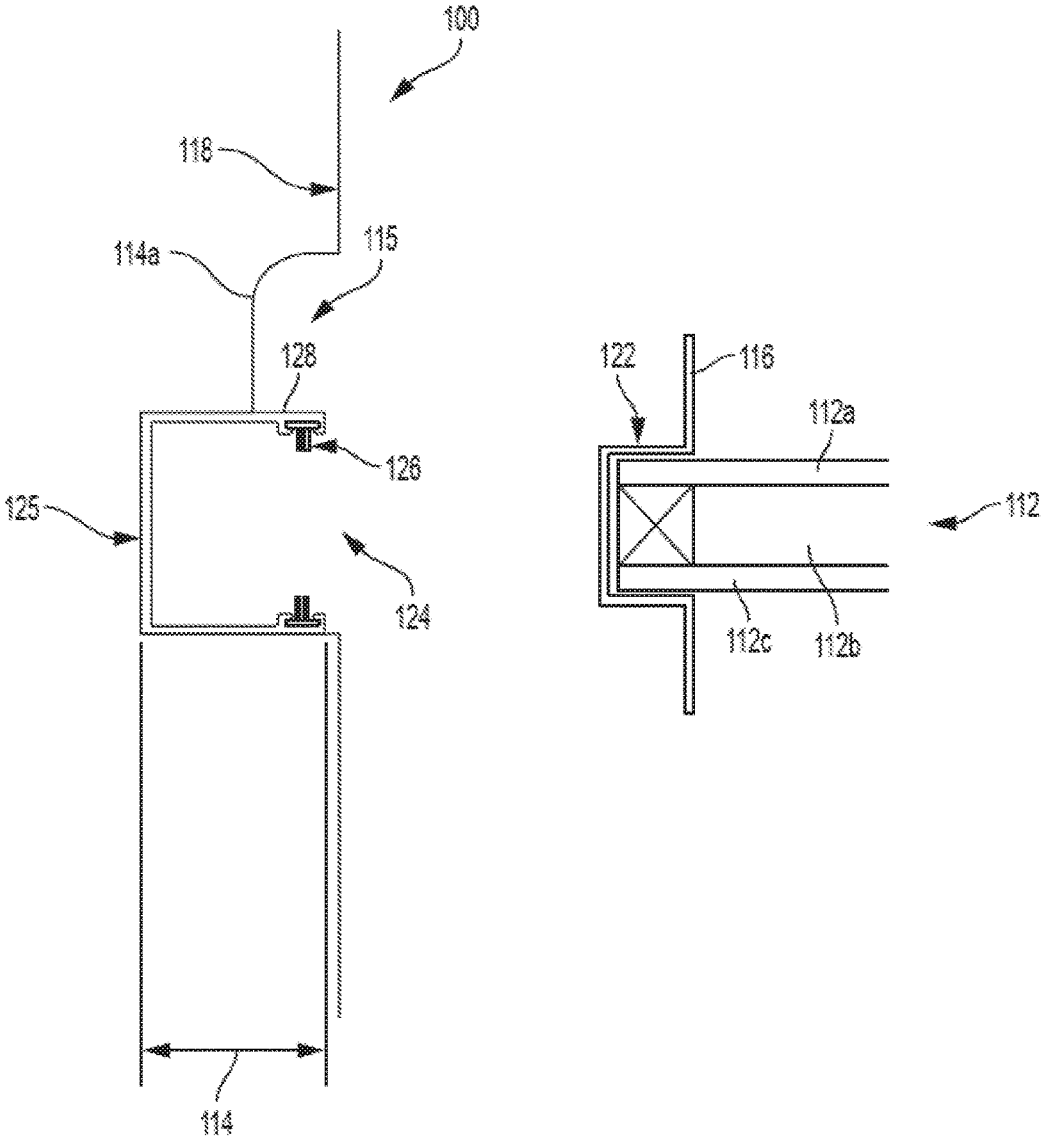
FIG. 8 is a plan view of a sliding window in an open position according to a second exemplary embodiment.
Figure 9:
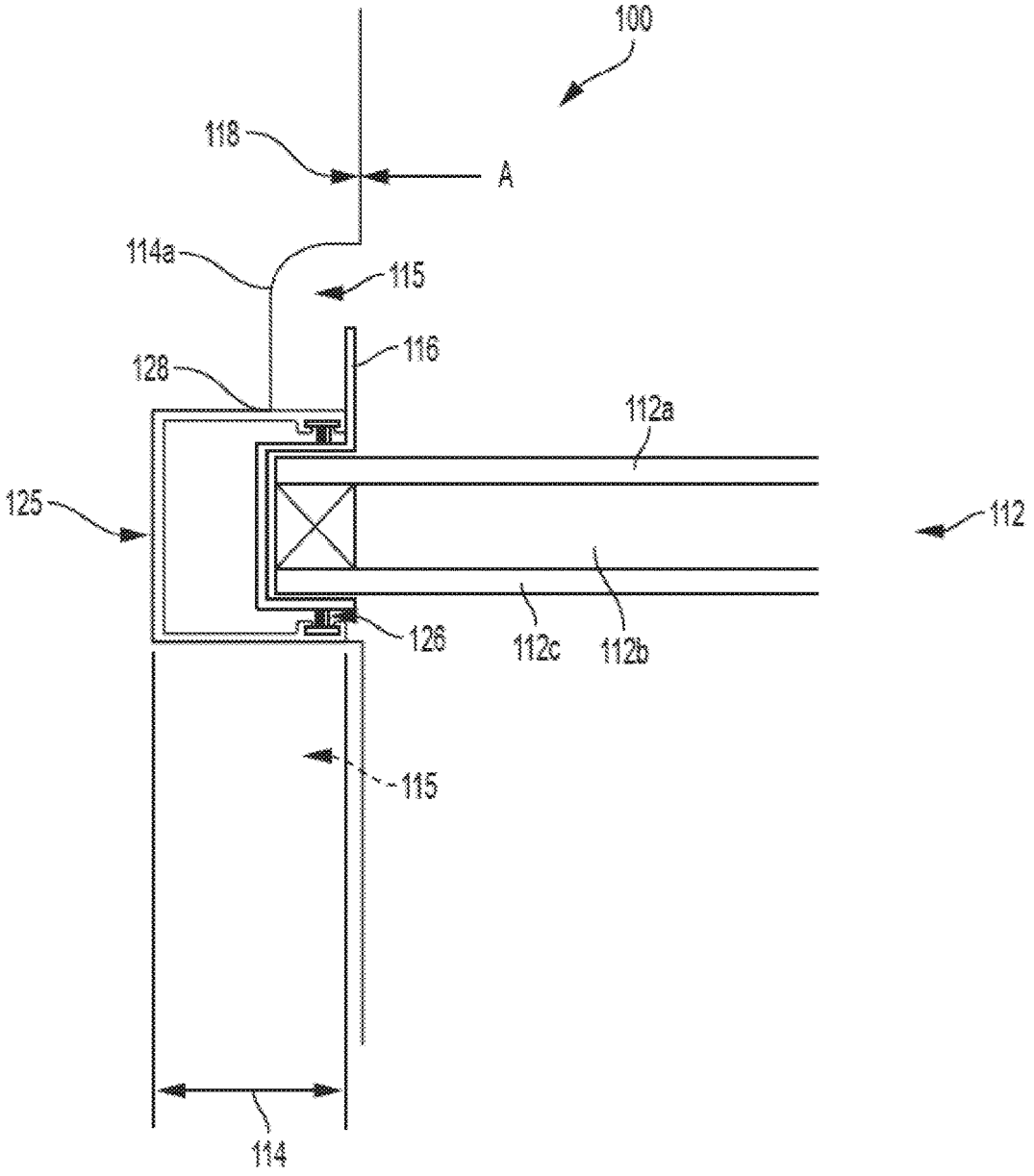
FIG. 9 is a plan view of a sliding window in a closed position according to the exemplary embodiment illustrated in FIG. 8.

FIG. 8 is a plan view and FIG. 9 is an elevation view of a sliding window 100 according to a second exemplary embodiment. Like reference numerals in FIGS. 8 and 9 refer to like features as described above. According the second exemplary embodiment, the sliding window 100 includes similar features to the sliding door 100. As shown in FIGS. 8 and 9, the sliding window 100 includes a handle 116 on only a single side of the sliding door 100. Furthermore, the jamb 125 defines only a single recessed handle pocket 115, on the same side as the handle 116. Other features and functions of the sliding window 100 are similar to those functions and features of the sliding door 100. For example, the sliding window 100 may include a jamb 125 having a lock 120.

The foregoing is illustrative of exemplary embodiments and is not to be construed as limiting thereof. Although a few exemplary embodiments have been described, those skilled in the art will readily appreciate that many modifications are possible without materially departing from the novel teachings and advantages. Accordingly, all such modifications are intended to be included within the scope of the claims.

What is claimed is:

1. A sliding assembly, comprising:

a panel member having at least one transparent member;

a handle connected to the panel member; and a jamb recessed in a wall, wherein the handle is at least partially received in the jamb when the panel member, which is configured to slide, is in a closed position such that the handle is inset at least partially into an outer portion of the wall; and when the panel member is in the closed position, a surface, that is configured to be grasped by a user to adjust the panel member to an opened position, of the handle extends parallel to and in the same plane as the outer portion of the wall.

2. The sliding assembly of claim 1, wherein the handle is not visible when viewed in a perpendicular direction with respect to a surface of the panel member when the panel member is in the closed position.

3. The sliding assembly according to claim 1, further comprising:

a sliding panel frame connected to the panel member, wherein the sliding panel frame is received by a receiver when the panel member is in the closed position.

4. The sliding assembly according to claim 3, wherein the handle is connected to the sliding panel frame.

5. The sliding assembly according to claim 1, wherein the jamb includes at least one recessed handle pocket, and wherein the at least one recessed handle pocket is configured to allow a user to interact with the handle.

6. The sliding assembly according to claim 5, wherein the at least one recessed handle pocket extends in a direction perpendicular to a sliding direction of the panel member.

7. The sliding assembly according to claim 6, wherein the at least one recessed handle pocket extends a length of the jamb.

8. The sliding assembly according to claim 1, further comprising:

a lock configured to prevent the panel member from being opened.

9. The sliding assembly according to claim 1, further comprising:

a seal for sealing the panel member with the door jamb when the panel member is in the closed position.

10. The sliding assembly according to claim 1, wherein the at least one transparent member is transparent, semi-transparent, or opaque.

11. A jamb for a sliding member, the jamb comprising:

at least one recessed handle pocket; and a receiver, wherein the jamb is recessed in a wall, the sliding member is at least partially received by the receiver when the sliding member is in a closed position such that a leading edge of a sliding panel frame is at least partially recessed in the wall such that a handle connected to the sliding member is inset at least partially into an outer portion of the wall when the sliding member is in a closed position, and when the sliding member is in the closed position, a planar surface, that is configured to be grasped by a user to adjust the sliding member to an opened position, of the handle is configured to extend parallel to and in the same plane as the outer portion of the wall.

12. The jamb according to claim 11, wherein a leading edge of the sliding member is completely recessed in the wall when the sliding member is in the closed position.

13. The jamb according to claim 11, further comprising:

a lock configured to prevent the sliding member from being opened.

14. A sliding panel frame for a sliding member, comprising:

a handle connected to the sliding panel frame; and at least one panel, wherein a leading edge of the sliding panel frame is at least partially received by a receiver of a jamb such that the sliding panel frame is at least partially recessed in a wall such that a surface, that is configured to be grasped by a user to adjust the sliding panel frame to an opened position, of the handle extends parallel to and in the same plane as an outer portion of the wall when the sliding panel frame is in a closed position.

15. The sliding panel frame according to claim 14, wherein the handle is not visible when viewed in a perpendicular direction with respect to a surface of the panel when the sliding panel frame is in the closed position.

16. The sliding panel according to claim 14, further comprising:

a locking member connected to the sliding panel frame, wherein the locking member is configured to interact with a portion of the jamb to lock the sliding panel frame in the closed position.

* * * * *